United States Patent [19]

Burton

[11] 4,388,876

[45] Jun. 21, 1983

[54] ASH REMOVAL SYSTEM

[75] Inventor: John A. Burton, Vancouver, Canada

[73] Assignee: Enterprises International, Inc., Olympia, Wash.

[21] Appl. No.: 251,397

[22] Filed: Apr. 6, 1981

[51] Int. Cl.[3] ..... F23K 3/18

[52] U.S. Cl. ..... 110/275; 110/277; 110/287; 110/288; 110/247; 110/170

[58] Field of Search ..... 110/170, 168, 166, 275, 110/277, 287, 288

[56] References Cited

U.S. PATENT DOCUMENTS

| | | | |
|---|---|---|---|
| 1,729,776 | 10/1929 | Hare | 110/277 |
| 1,871,653 | 8/1932 | Best | 110/275 |
| 1,891,809 | 12/1932 | Galusha | 110/275 |
| 1,913,668 | 6/1933 | Haug | 110/275 |
| 1,956,939 | 5/1934 | Wynn, Jr. | 110/287 |
| 1,974,205 | 9/1934 | Corbett | 110/277 |
| 2,119,937 | 6/1938 | Banfield | 110/287 |
| 2,361,883 | 10/1944 | Snyder | 110/277 |
| 2,366,966 | 1/1945 | Julyan et al. | 110/277 |
| 2,370,067 | 2/1945 | Palmer | 110/277 |
| 4,137,051 | 1/1979 | Godwin | 110/247 |

*Primary Examiner*—Henry C. Yuen

*Attorney, Agent, or Firm*—Seed, Berry, Vernon & Baynham

[57] ABSTRACT

An ash removal apparatus for a burner which produces ash moved through a discharge passage in the floor of the burner, including a circumferential ash-removing opening surrounding the grate of the burner, with the surfaces forming the opening being circumferentially progressively varied in spacing to crush and pass clinkers through the opening and out the discharge passage.

3 Claims, 3 Drawing Figures

ASH REMOVAL SYSTEM

DESCRIPTION

1. Technical Field

This invention pertains to large burners of the type which form a quantity of ash which must be removed from the burner, some of that ash being in the form of large clinkers. More specifically, the invention relates to an ash removal system for such burners in which the clinkers are removed along with the ash.

2. Background Art

Various techniques have been used heretofore for the automatic removal of the ash from a burner, particularly those fueled by waste wood or other combustible materials that produce ash. Generally, these prior devices have utilized a rotating horizontal plate on the floor of the burner and swept the ash from the floor through an ash removal opening by some form of fixed sweeping arm. In other instances, the surface on the floor of the burner has been stationary, and rabble arms have been rotated to sweep the ash from the floor. These prior art devices work well as long as the consistency of the ash is reasonably uniform and of small particulate size. Occasionally, however, a large clinker will form in the ash and will bridge the ash removal opening, causing a disruption in the flow of ash from the burner floor.

DISCLOSURE OF THE INVENTION

It is an object of this invention to provide an ash removal system which eliminates clinkers which may block the passage of ash out of the ash removal opening.

It is another object of this invention to provide a much improved ash removal system which crushes the clinkers as they are discharged. This crushing feature, in combination with an ash removal opening, uniquely employs general principles such as are employed for rock or ore crushing to maintain the opening clean of ash flow impediments.

Basically, these objects are achieved by forming the ash removal opening with a pair of radially spaced, downwardly converging plates which at least partially encircle the center grate of the burner, one of the plates being movable radially relative to the other to crush any clinkers bridging the two plates. Preferably, the movable plate is moved in an oscillatory motion which circumferentially, progressively varies the radial spacing between the plates. The flow of the ash through the plates is by gravity, with the gravity flow being assisted by movement of a downwardly depending surface on the movable plate so the ash is moved radially to a discharge removal station.

In the preferred embodiment, the radially outer plate on the opposed plates forming the ash removal opening is the movable plate and is moved by an annular driving disc of varying horizontal width with disc bearings circumferentially surrounding the inner and outer edges of the driving disc to transmit the radial movement of the inner edge of the driving disc to the movable, downwardly converging plate.

BEST MODE FOR CARRYING OUT THE INVENTION

Figure 1:
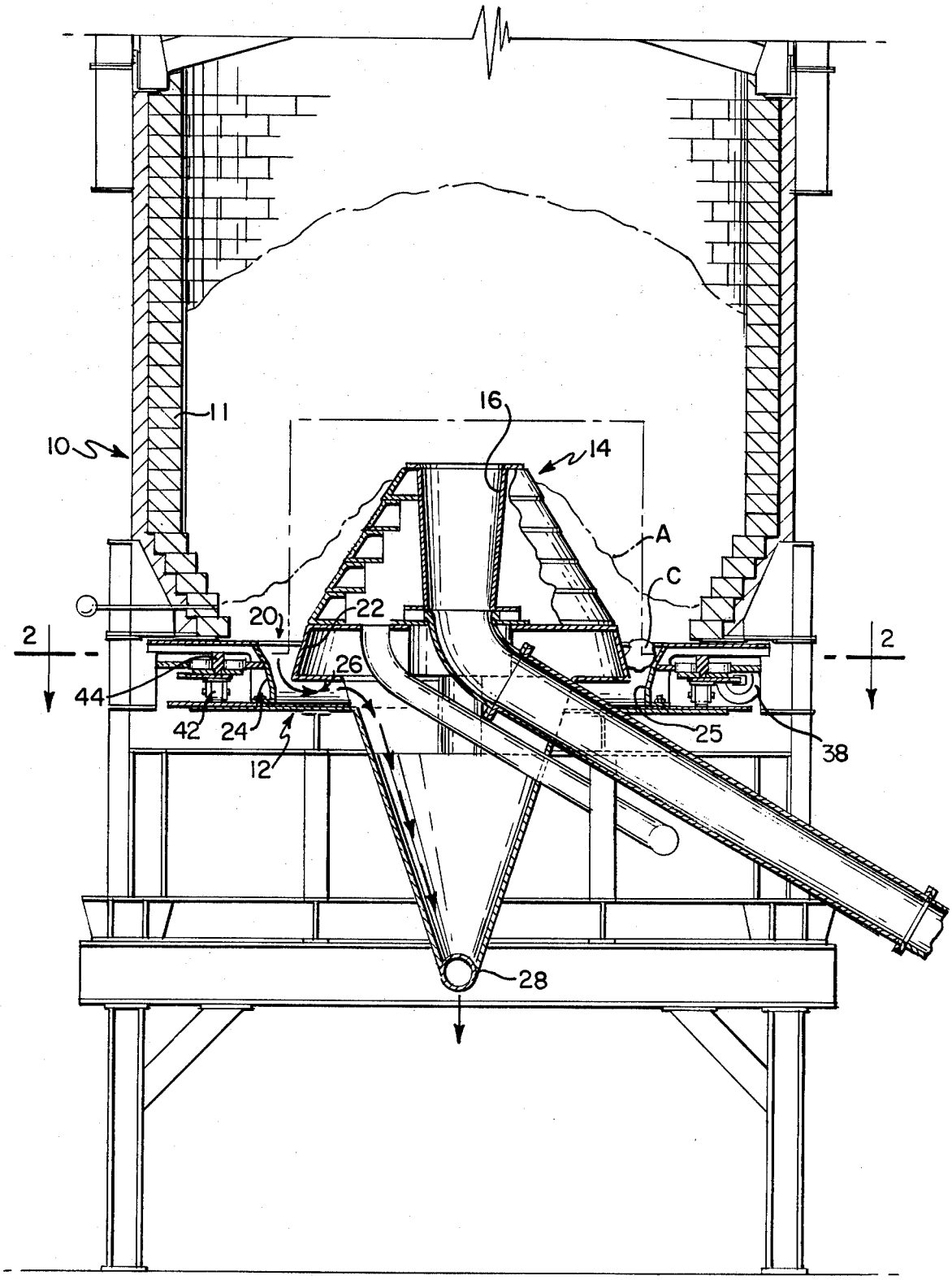
FIG. 1 is a vertical section taken through a burner showing the ash removal system of this invention.

As best shown in FIG. 1, the burner includes a combustion chamber 10 having a sidewall 11 terminating downwardly, generally in a floor 12. Centrally extending radially and upwardly from the floor is a grate 14 in the general shape of a cone. Fuel is moved through a feed opening 16 to form a pile on the grate, with oxidation of the fuel occuring in any suitable manner. A typical burner of this configuration is shown in U.S. Pat. No. 4,177,740 and in copending patent application Ser. No. 201,313, filed Oct. 27, 1980, the descriptions of which are incorporated herein by reference thereto.

As is well known, oxidation of the fuel forms a pile of ash A which moves by gravity downwardly to the floor of the burner. In this embodiment, an ash removal opening 20 completely surrounds the grate 14 and is formed by a fixed circumferential plate 22 and a moving circumferential plate 24 which are arranged in downwardly converging relationship to one another. The movable plate 24 has a lower circumferential surface 25 which, when moved, assists in pushing the ash radially through an ash-discharging gap 26 and down to a conventional rotary air lock 28 for removing the ash from the burner.

Figure 2:
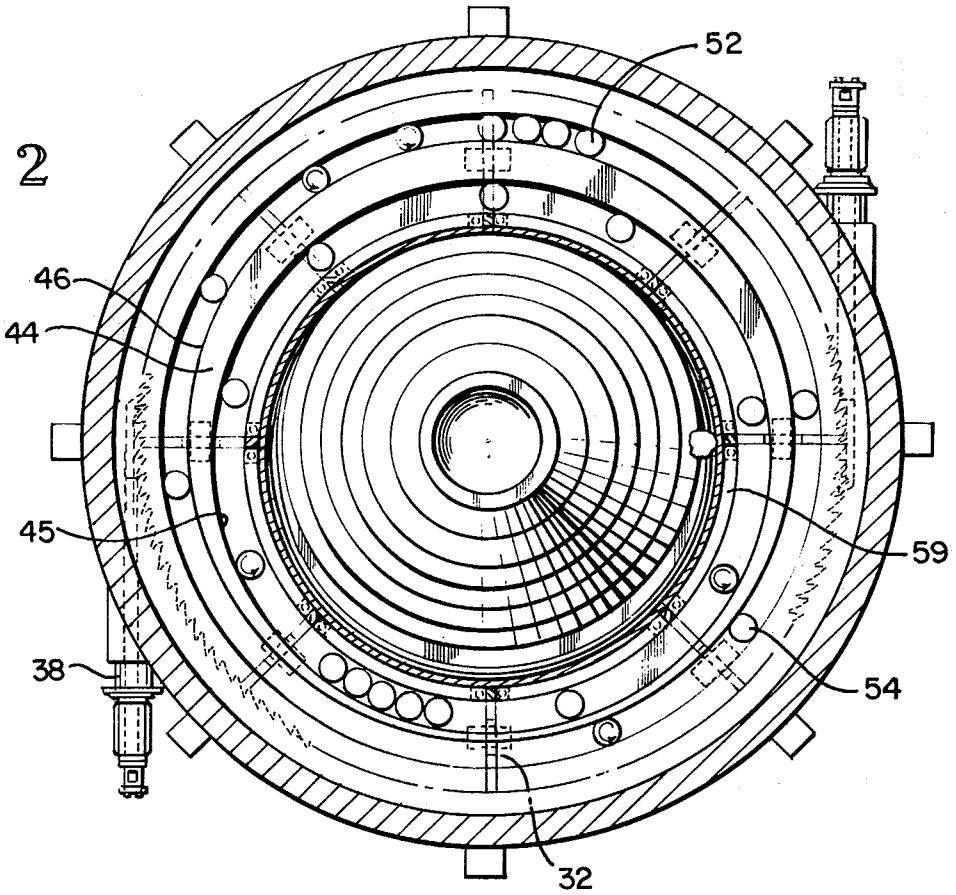
FIG. 2 is a schematic horizontal section taken generally along the line 2—2 of FIG. 1.
Figure 3:
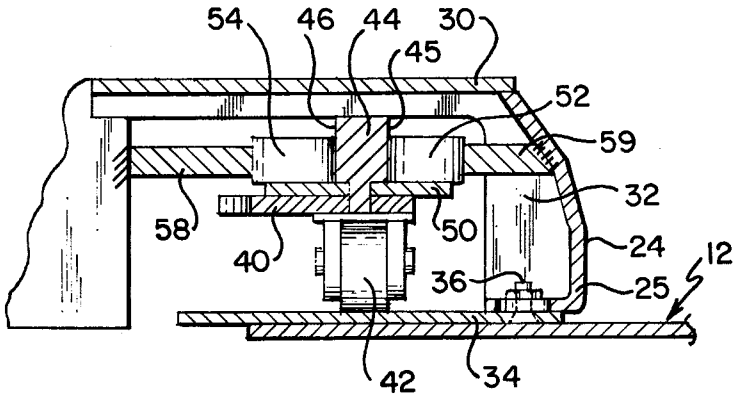
FIG. 3 is a fragmentary vertical section showing the detail of the preferred embodiment of the ash removal system of this invention.

As is also best shown in FIG. 1, the downwardly converging plates 22 and 24 will catch a clinker C and hold the clinker in the discharge opening 20 until the clinker is crushed to a much smaller size, when it can then freely pass through the discharge gap and out the rotary air lock. For this purpose, and as best shown in FIGS. 2 and 3, the movable plate has a radially and circumferentially extending horizontal surface 30. The plate 24, its extension 25, and the horizontal surface 30 are supported for rotation by a plurality of webs 32 which are carried on a bottom ring 34 and bolted thereto by bolts 36. The bottom plate rests on the floor of the burner and slides thereon as the plate 24 is oscillated.

The plate 24 is oscillated by a pair of opposed ratchet cylinders 38 which, in a conventional manner, drive a toothed carrier 40. The carrier is provided with a plurality of rollers 42 and has fixed thereto an annular driving plate 44 of a varying horizontal thickness between its radially inner and outer edges 45 and 46.

The carrier also is provided with a bearing support 50 which carries inner and outer sets of freely floating discs 52 and 54. The outer discs ride against a circular ring 58 which is fixed to the wall of the burner. The inner discs engage a circumferential flange 59 attached to the plate 24.

As the ratchet 38 rotates the annular driving plate 44 via carrier 40, its varying horizontal width progressively rotates about the center of the burner such that the bearing discs push the plate 24 in an oscillatory or woobling motion progressively about the center of the burner. This progressively changes the distance between the plates 24 and 22 with sufficient force that any clinker C is periodically crushed by the plates. Continued movement of the movable plate 25 then moves the crushed clinker along with the remaining ash through the discharge gap 24, where it is removed through the rotary air lock 28.

While the preferred embodiment of the invention has been illustrated and described, it should be understood that variations will be apparent to one skilled in the art without departing from the principles herein. Accordingly, the invention is not to be limited to the specific embodiment illustrated in the drawing.

I claim:

1. An ash removal apparatus for a burner forming ash including large clinkers and having a combustion chamber, a floor, a grate on said floor, and an ash-removing passage in said floor at least partially encircling said grate, said apparatus comprising a set of opposed, downwardly converging first and second surfaces defining an ash-removing opening, at least one of said surfaces being movable solely radially toward the other surface for crushing large clinkers passing therebetween, means for moving said movable surface radially but without substantial circumferential movement, and means for discharging the ash including crushed clinkers through said ash-removing passage, said movable surface being carried on a continuous, generally cylindrical plate, means for mounting said cylindrical plate for radial, circumferentially progressive, eccentric, oscillatory motion so that the radial movement of the movable surface progresses circumferentially around said grate, said means for mounting said cylindrical plate including a roller carrier having a plurality of rollers thereon for moving in a horizontal circular path and an annular driving plate having a varying horizontal width defined by inner and outer edges whereby the radial distance from the center of the burner to the inner edge of the driving plate at any point in the burner varies upon rotation of the driving plate, and bearing means for transmitting the rotation of the driving plate inner edge to said oscillatory motion of said movable surface.

2. The system of claim 1, said bearing means including inner and outer circumferentially spaced discs abutting opposite circumferential edges of said driving plate, said outer spaced discs rolling against a fixed ring, the inner discs rolling against the movable cylindrical plate.

3. An ash removal apparatus for a burner forming ash including large clinkers and having a combustion chamber, a floor, a grate on said floor, and an ash-removing passage in said floor at least partially encircling said grate, said apparatus comprising a set of opposed, downwardly converging first and second surfaces defining an ash-removing opening, at least one of said surfaces being movable solely radially toward the other surface for crushing large clinkers passing therebetween, means for moving said movable surface radially but without substantial circumferential movement, and means for discharging the ash including crushed clinkers through said ash-removing passage, said grate being raised in a generally conical shape, said first surface extending downwardly from said grate, the opposite surface spaced therefrom to form said ash-removing opening, and at least one of said surfaces being angled to converge, said first surface terminating downwardly less than said second surface to form a continuous discharge gap, said second surface being the movable surface and having a lower end for assisting in moving the ash through said discharge gap, said movable second surface being carried on a continuous, generally cylindrical crushing plate, means for mounting said crushing plate for radial oscillatory motion including a rotatable annular driving plate having a circumferentially varying horizontal radial thickness, and bearing means for transmitting the varying motion of the inner edge of the driving plate to said oscillatory movement of the second surface.

* * * * *